United States Patent [19]

Prince

[11] 4,007,125

[45] Feb. 8, 1977

[54] SYNTHETIC DETERGENT BAR

[75] Inventor: Leon M. Prince, Westfield, N.J.

[73] Assignee: Lever Brothers Company, New York, N.Y.

[22] Filed: Dec. 26, 1973

[21] Appl. No.: 427,757

[52] U.S. Cl. ..... 252/117; 252/121; 252/134; 252/174; 252/554; 252/DIG. 16

[51] Int. Cl.[2] ..... C11D 10/04

[58] Field of Search ..... 252/174, 134, 121, 554, 252/DIG. 16, 117

[56] References Cited

UNITED STATES PATENTS

| | | | |
|---|---|---|---|
| 2,894,912 | 7/1959 | Geitz | 252/121 |
| 3,001,948 | 9/1961 | Clippinger | 252/554 X |
| 3,186,948 | 6/1965 | Sweeney | 252/DIG. 16 X |
| 3,247,121 | 4/1966 | Hendricks | 252/DIG. 16 X |
| 3,622,517 | 11/1971 | Norton | 252/554 |

*Primary Examiner*—Harris A. Pitlick
*Attorney, Agent, or Firm*—Kenneth F. Dusyn; James J. Farrell; Melvin H. Kurtz

[57] ABSTRACT

Toilet detergent tablets having the property of softening in the soap dish to form a slimy, gel-like, mushy hydrate, and containing about 30 to about 60% sodium acyl isethionate detergent are made firmer and the tendency to form a mushy hydrate is decreased, and the rate of drying of the hydrate is increased, if there is incorporated in the bar about 10 to about 20% of sodium alkanesulfonate wherein the alkane group has 12–14 carbon atoms.

7 Claims, No Drawings

SYNTHETIC DETERGENT BAR

BACKGROUND OF THE INVENTION

1. Field of the Invention

The present invention is concerned with the presence of alkanesulfonates in a toilet detergent tablet having an acyl isethionate as the predominant surface active detergent, to lessen the tendency of the tablet to form mush in the holder.

It is well known that toilet tablets, both those based on soap and on nonsoap synthetic detergents, hydrate or absorb water, when left wet in the conventional holder, or dish, after using. The hydrate is soft, and this condition may exist not only on the surface but for some distance below the surface. The hydrate falls from the tablet, or is removed during the next usage, depending upon the degree of softness. This softening and removal is variously referred to as sliming, sloughing, melting, slushing, smearing, slopping, mushing, etc.

Various additives have been incorporated in soap and detergent tablets to ameliorate mushing tendencies, as set forth elsewhere herein. However, it is believed that the anti-mushing agents of the present invention have particular adaptability to nonsoap detergent toilet tablets wherein an acyl isethionate is the predominant surface-active agent.

2. The Prior Art

U.S. Pat. No. 2,197,800 discloses a process for reacting a paraffinic hydrocarbon with a gaseous mixture of sulfur dioxide and chlorine.

U.S. Pat. No. 3,001,948 relates to a synthetic detergent bar consisting essentially of an ammonium alkanesulfonate admixed with an alkali metal or alkaline earth alkanesulfonates, the alkane portion being primary straight chain radicals having 8–20 carbon atoms and averaging 12–16 carbon atoms.

U.S. Pat. No. 3,186,948 discloses a 1:1 mixture of alkanesulfonate and secondary alkyl sulfate.

U.S. Pat. Nos. 3,228,980 and 3,297,579 disclose alkanesulfonates having an odd number of carbon atoms, and a process for their preparation.

U.S. Pat. No. 3,533,954 relates to washing powders consisting essentially of a soap and an aliphatic alpha sulfonate.

U.S. Pat. No. 3,541,140 describes a method for preparing sodium alkanesulfonates.

U.S. Pat. No. 3,652,662 discloses the use of hydrogenated olefin sulfonates in bar form.

The procedures for preparing alkali metal acyl isethionates are well known to those skilled in the art. The reaction between isethionic acid free of its salts, and fatty acids is described in U.S. Pat. No. 3,151,136. The acid reaction product is neutralized preferably with a mixture of sodium hydroxide and sodium disilicate. U.S. Pat. No. 3,320,292 discloses the use of a basic zinc compound as a catalyst in the preparation of an acyl isethionate from a fatty acid and sodium isethionate, while U.S. Pat. No. 3,383,396 discloses the use of a zirconium compound in the same preparation. The basic bar composition is described in U.S. Pat. No. 2,894,912. U.S. Pat. Nos. 3,420,857 and 3,420,858 disclose processes for controlling the distribution of the several chain-length fatty acids used in the admixture in the preparation of acyl isethionates. U.S. Pat. No. 3,429,136 discloses a step of flash-cooling acyl isethionates after preparation

SUMMARY OF THE INVENTION

It has now been discovered that the mushing tendencies of a toilet detergent tablet containing about 30% to about 60% of a sodium acyl isethionate can be greatly reduced by the incorporation therein of relatively low proportions of alkanesulfonates having 12 to 14 carbon atoms.

Soaps in tablet form are subject to mushing, but to a lesser degree than are the nonsoaps, and moreover the soaps lose water picked up during use more rapidly than the nonsoaps, and recover their firmness sooner. The presence of alkanesulfonate in the predominantly nonsoap tablets of the present invention shifts the rate of firmness recovery toward the more rapid rate of recovery inherent in soap tablets.

The present invention is particularly useful under conditions wherein the detergent tablets are re-used after only about a 10-minute to about a 3-hour drying period under normal household conditions.

DETAILED DESCRIPTION OF THE INVENTION

The present invention is applicable to toilet detergent tablets of the type disclosed and claimed in U.S. Pat. No. 2,894,912, assigned to the instant assignee, and incorporated herein by reference. The aforementioned tablets consist essentially of about 30 to about 70% of water-soluble alkali metal detergent salts of esters of isethionic acid with mixed aliphatic fatty acids having from 6 to 18 carbon atoms and an iodine value of less than 20, of which mixed acids at least 75% have from 12 to 18 carbon atoms and up to 25% have from 6 to 10 carbon atoms, from 2 to 10% of at least one water-soluble suds-boosting detergent salt selected from the group consisting of alkali metal and organic amine higher aliphatic fatty alcohol sulfates, alkyl aryl sulfonates, and the higher aliphatic fatty acid taurides, from about 1 to about 9% water, from about 2.5% to about 25% of water-soluble higher fatty acid soap, and from 10 to 40% of at least one higher fatty acid having from about 12 or about 25 carbon atoms as a binder and plasticizer, said bar having a pH within the range from 6 to 8, measured as a 10% aqueous solution of the bar composition at 35° C.

It is an object of the present invention to provide a toilet detergent tablet having a reduced tendency to form mush in the dish, and to provide an increased rate of loss of water of hydration absorbed on the tablet during use.

The present invention in its broadest aspect relates to a toilet detergent tablet having therein about 30% to about 60% of a sodium acyl isethionate having a molecular weight in the detergent range and containing as an anti-mushing agent about 10% to about 20% of a sodium alkanesulfonate having 12–14 carbon atoms, or mixtures thereof.

In another aspect the invention relates to a process for lessening the mushing tendencies of a toilet detergent tablet having therein about 30 to about 60% of a sodium acyl isethionate having an acyl group of about 6 to about 18 carbon atoms, comprising incorporating into said bar an anti-mushing agent described hereinabove.

More specifically, the process is applicable to a toilet detergent tablet containing an acyl isethionate in a proportion not exceeded by any other component therein, and in the proportions of about 30 to about 60%, comprising incorporating into said tablet from about 10 to about 20% of an anti-mushing agent selected from the group consisting of sodium dodecanesulfonate and sodium tetradecanesulfonate, and mixtures of said agents, said tablet having improved hardness, improved firmness recovery characteristics, and being substantially free from efflorescence, and having a pH within the range of about 6 to about 8, measured as a 10% aqueous solution of the bar composition at 35° C.

Accordingly the invention provides a toilet detergent tablet comprising from about 30% to about 60% of water-soluble alkali metal detergent salts of esters of isethionic acid with mixed aliphatic fatty acids having from 6 to 18 carbon atoms and an iodine value of less than 20, of which mixed acids at least 75% have from twelve to eighteen carbon atoms and up to 25% have from six to ten carbon atoms, from 2 to 10% of at least one water-soluble suds-boosting detergent salt selected from the group consisting of alkali metal and organic amine higher aliphatic fatty alcohol sulfates, alkyl aryl sulfonates, and the higher aliphatic fatty acid taurides, from about 1 to about 9% water, from about 2.5 to about 25% of water-soluble higher fatty acid soap, and from 10 to 40% of at least one higher fatty acid having from about twelve to about twenty-five carbon atoms as a binder and plasticizer, and an anti-mushing agent in the proportions of about 10 to about 20%, said tablet having improved hardness and firmness recovery characteristics, and having a pH within the range of about 6 to about 8, measured as a 10% aqueous solution of the bar composition at 35° C.

The invention also provides a toilet detergent tablet comprising the following components in parts by weight:

| | Parts by Weight of Tablet |
|---|---|
| a. Sodium acyl isethionate | 40–60 |
| b. Fatty acid | 15–25 |
| c. Soap of a higher fatty acid | 5–15 |
| d. Sodium isethionate | 2–5 |
| e. Sodium alkylbenzenesulfonate | 2–4 |
| f. Sodium alkanesulfonate having 12–14 carbon atoms | 10–20 |
| g. Water | 3–6 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22% has 8–14 carbon atoms, the alkyl group of said alkylbenzenesulfonate is derived from a straight-chain hydrocarbon mixture having an average of about 13 carbon atoms, the sum of (a) through (g) lies within the range of about 96 to about 100 parts by weight, whole composition basis.

As a preferred embodiment, the tablets of the present invention comprise the following components in the proportions indicated.

| | Parts by Weight of Tablet |
|---|---|
| a. Sodium acyl isethionate | 44–55 |
| b. Fatty acid | 16–20 |
| c. Soap of a higher fatty acid | 9–13 |
| d. Sodium isethionate | 1.5–2 |
| e. Sodium alkylbenzenesulfonate | 1–3 |
| f. Sodium alkanesulfonate having 12–14 carbon atoms | 12–18 |
| g. Water | 3–6 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22% has 8–14 carbon atoms, the alkyl portion of said alkylbenzenesulfonate is derived from a straight-chain hydrocarbon mixture having an average of about 13 carbon atoms, the sum of (a) through (g) lies within the range of about 96 parts to about 100 parts by weight, the balance, if any, consisting of minor additives, such as germicides, $TiO_2$, colorants, and miscellaneous ingredients associated with the above-named components.

Useful tablets in accordance with the invention have the following approximate composition.

| | Parts by Weight of Tablet |
|---|---|
| Sodium acyl isethionate[a] | 44–45 |
| Stearic acid | 17–19 |
| Coconut oil fatty acids | 2–3 |
| Soap of mixed tallow and coconut oil[b] | 7–8 |
| Sodium stearate | 2–3 |
| Sodium isethionate | 4–5 |
| Sodium alkylbenzenesulfonate[c] | 2–3 |

[a]the alkyl group is derived from coconut oil.
[b]about 75–85 parts tallow and about 15–25 parts coconut oil.
[c]the alkyl group is a straight chain having about 11–15 carbon atoms.

| | Parts by Weight of Tablet |
|---|---|
| Sodium alkanesulfonate having 12–14 carbon atoms | 12–18 |
| $TiO_2$ | 0.1–0.3 |
| Germicides | 0–1.5 |
| Perfume | 0.7–1.5 |
| Colorants | 0.001–0.003 |
| Miscellaneous[d] | 1.5–4 |
| Water | 4–5 |

[d]inert matter unavoidably added in association with the components

The invention further provides a process for lessening the mushing tendencies of a toilet detergent tablet containing an acyl isethionate in a proportion not exceeded by any other component therein, and in the proportions of about 30 to about 60%, comprising incorporating into said bar from about 3 to about 20% of an anti-mushing agent which is a sodium alkanesulfonate having 12–14 carbon atoms, said tablet having improved hardness and firmness recovery characteristics, and being substantially free from efflorescence, and having a pH within the range of about 6 to about 8, measured as a 10% aqueous solution of the bar composition at 35° C.

A particular advantage accruing from the practice of this invention is the improved recovery of the tablets from the mushiness imparted during use of the bar. A test to show this advantage has been devised wherein the tablet is allowed to hydrate under exaggerated conditions, and subsequently allowed to dry in the air.

Tablets of the instant invention, when submitted to this test, described below as the Firmness Recovery Test, lose the water of hydration more rapidly, and in so doing become firmer than tablets of comparable composition which do not contain the instant anti-mush additives.

The rate at which a toilet detergent tablet wears away during use is quantitatively determined by measuring the rate at which the tablet loses weight during a standarized washing procedure, referred to as the "Wear Rate Test" whereby the weight of the tablet consumed per use is determined. The Wear Rate Test is conducted in accordance with the description below. It will be understood that the results obtained by this test may vary slightly from operator to operator and may also show variations from day to day, but that the results obtained on tablets tested as a group by the same operator may be validly compared. For this reason control tablets are tested along with the tablets of each Example herein.

Wear Rate Test

Material a. Smooth flat-bottomed plastic soap dishes,
b. Pin rack or other point support for drying tablets,
c. Gallon container marked at one-half gallon.

Procedure

The test begins of the morning of Day 1 and terminates on the morning of Day 3. Record the initial weight of the tablet to the nearest 0.01 gram. Prepare one-half gallon of tap water at 105° F in the 1 gallon container. Submerge the hands and the tablet in the 105° F water, remove both the tablet and hands and rotate the tablet 20 times between the hands (1 rotation = 180°). Submerge the tablet and hands in the water, remove the tablet and hands, and repeat the above described washing (20 rotations). Submerge the tablet and hands in the water, remove the tablet in the hands and place the tablet in the dish. Repeat the above described washing 4 times during the day on Day 1 and Day 2.

Tap water at 80° F is added to the dish prior to placing the tablet in the dish following the first and last wash on Day 1 and Day 2 (6½ ml of tap water for regular size, 7½ ml of tap water for bath size).

On the morning of Day 3 with the tablet as before, rinse in the wash water, and place on pin rack to dry. Dry tablet at least 4 hours and weigh to nearest 0.01 gram.

Calculation

Calculate the weight in grams used per wash:

$$\frac{\text{Initial weight in grams} - \text{final weight in grams}}{\text{number of washes}} = \text{grams per use}$$

Firmness Recovery Test

Weighed tablets of the same size and shape are submerged end-wise to half their length in distilled water at room temperature for 5 minutes. The tablets are removed from the water, weighed and placed on a rack designed to allow free access of air to the immersed portion. The tablets are weighed at desired intervals as they progressively dry. For purposes of comparison of the tablets one with the other, the weight of water absorbed during the 5 minute immersion is taken as 100%. The weight of absorbed water remaining at each subsequent weighing is converted to a percentage by weight of the water initially absorbed. A comparison of the figures thus obtained provides comparative information on the rate of loss of absorbed water, which, experience has shown, correlates with the return of the wet tablet to its original firmness.

If desired, visual observations may be made at each weighing step to observe the rate at which the tablet returns to its original firmness.

Lather Test

Three panelists each test three different tablets of the same composition, each tablet under a different set of water hardness and temperature conditions, i.e., a. Edgewater water (90-110 ppm hardness as $CaCO_3$) at 75° F,
b. 180 ppm hardness as $CaCO_3$ at 75° F, and
c. 180 ppm hardness as $CaCO_3$ at 110° F.

The panelist washes his hands in his customary manner under the aforementioned conditions, and rates the tablets of different compositions in accordance with his preference within each test condition, the tablet producing the best lather being rated 1, the second best 2, etc. The relative score assigned to each tablet is the sum of the ratings for the tablet assigned each of the three panelists. By this rating system, the lower the number, the higher the rating. For example, if two tablet compositions are tested, and one is preferred throughout, the preferred tablet has a score of 9 while the non-preferred tablet has a score of 18.

The essence of the present invention is the use of the above-mentioned anti-mushing agent in detergent bars wherein sodium acyl isethionate is present in a proportion not exceeded by any other component therein.

The sodium acyl isethionate component may be prepared by methods well known to those skilled in the art. Suitable preparatory procedures may be found in U.S. Pat. Nos. 3,320,292, 3,376,229, 3,151,136, 3,383,396, 3,420,857 and 3,420,858.

The alkylbenzenesulfonates useful in the present invention may have a branched alkyl group of about 9 to about 15 carbon atoms such as may be derived from polypropylene as described in U.S. Pat. Nos. 2,477,382 and 2,477,383. Preferably the alkyl group is a straight chain having about 11 to about 15 carbon atoms and the sulfonated phenyl group is randomly positioned along the alkyl chain. Also useful are the alkylbenzenesulfonates described in U.S. Pat. Nos. 2,390,295, 3,320,174 and in Nos. 2,712,530 and 2,723,240.

The term "soap" is used herein in its popular meaning, i.e., the alkali metal salts of aliphatic alkane-or alkenemonocarboxylic acids. In general, the sodium soaps are used in the bars of the invention, but from about 1 to about 25% of the soap may be potassium soaps. The soaps useful herein are the well-known alkali-metal salts of natural or synthetic fatty (alkanoic or alkenoic) acids having about 12 to about 20 carbon atoms, preferably about 12 to about 18 carbon atoms, and may be described as alkali-metal carboxylates of acyclic hydrocarbons having about 12 to about 20 carbon atoms.

Soaps having the fatty acid distribution of coconut oil may provide the lower end of the broad molecular weight range, while soaps having the fatty acid distribution of peanut or rapeseed oil, or their hydrogenated derivatives, may provide the upper end of the broad molecular weight range. It is preferred to use the soaps having the fatty acid distribution of coconut oil or tallow, or mixtures thereof, since these are among the more readily available fats. The proportion of fatty acids having at least 12 carbon atoms in coconut oil soap is about 84%. This proportion will be greater when mixtures of coconut oil and fats such as tallow, palm oil, or non-tropical nut oils or fats are used, wherein the principal chain lengths are $C_{16}$ and higher. The preferred soap for use in the present invention then has at least 84% fatty acids having about 12–18 carbon atoms.

It will be understood that the coconut oil employed for the soap, and for the isethionate as well, may be substituted in whole or in part by other "high-lauric" oils, that is, oils or fats wherein at least 50% of the total fatty acids are composed of lauric or myristic acids or mixtures thereof. These oils are generally exemplified by the tropical nut oils of the coconut oil class, such as palm kernel oil, babassu oil, ouricuri oil, tucum oil, cohune nut oil, murumuru oil, jaboty kernel oil, khakan kernel oil, dika nut oil, and for present purposes ucuhuba butter, a vegetable triglyceride high in myristic acid esters.

A preferred soap is a mixture of about 15 to about 20% coconut oil and about 80 to about 85% tallow. These mixtures contain about 95–96% fatty acids having about 12 to about 18 carbon atoms. The soap may be prepared from coconut oil, in which case the fatty acid content is about 84% of $C_{12}$–$C_{18}$ chain length.

The soaps may contain unsaturation in accordance with the commercially acceptable standards. Excessive unsaturation is normally avoided.

The soaps may be made by the well-known kettle boiling process from natural fats and oils such as tallow or coconut oil or their equivalents, by boiling with an alkali-metal hydroxide, using procedures well known to those skilled in the art. Alternatively the soaps may be made by neutralizing fatty acids, such as lauric ($C_{12}$), myristic ($C_{14}$), palmitic ($C_{16}$), or stearic ($C_{18}$) acids with an alkali-metal hydroxide or carbonate.

The fatty alcohol sulfates useful in the practice of the present invention are alkyl sulfates wherein the alkyl group may be straight or branched, saturated or unsaturated, and have 6 to 24 carbon atoms, preferably about 12 to about 18 carbon atoms. A preferred tauride is sodium N-dodecanoyl-N-methyl taurine.

The term "predominant", as used in connection with the proportion of acyl isethionate, means that the proportion of acyl isethionate is not exceeded by any other surface-active agent in the composition.

The alkanesulfonates suitable for use in the practice of the present invention are the well-known alkane-1-sulfonates having the formula:

$$RSO_3Na$$

wherein R is an aliphatic hydrocarbon group having 12–14 carbon atoms, i.e., R in the above formula is $C_{12}H_{25}$, $C_{13}H_{27}$, or a $C_{14}$–$H_{29}$—. The alkanesulfonates may be prepared in accordance with the procedure described in U.S. Pat. No. 3,541,140.

All percentages and proportions are on the whole composition basis unless otherwise stated.

The invention may be more thoroughly understood by reference to the following Examples, which are to be considered illustrative, but not limitative, of the invention.

EXAMPLE 1

5750 pounds of sodium acyl isethionate having 75% active detergent matter are prepared in the following manner:

2965 lbs. of coconut fatty acids and 833 lbs. of fatty acids recovered in the stripping step of a previously prepared batch of fatty acid isethionate are combined in a scale tank. A slurry containing approximately 75% by weight of sodium isethionate on a 100% pure basis are charged into a stock tank. Finally, 8 lbs. of zinc oxide are prepared as an aqueous slurry in another tank.

All of the foregoing ingredients are charged into a reactor and heated therein to a temperature of about 450° F by circulating the contents of the reactor through a heat exchanger via a pump.

When the temperature of the reaction mixture reaches about 380°–400° F, water evolved by the reaction together with steam distilled fatty acids begin to distill from the reactor. These vapors are condensed in a condenser. The fatty acids and water condensate are collected in a separator in which separator the fatty acids are decanted via a pipe and accumulated in a collecting tank.

The reaction is essentially complete in approximately 150 minutes at 450°–460° F, and both fatty acids and water cease to accumulate in the separator.

At this point, the reaction mixture is drained into a stripper which is also purged with nitrogen to maintain an oxygen-free atmosphere. By circulating a heat transfer liquid through the jacket of the stripper, the temperature of the reaction mixture is maintained between about 430° and 460° F.

A vacuum is applied by means of ejectors to obtain a vacuum of about 20 inches of mercury. After maintaining this vacuum for a period of about 15 minutes, 963 lbs. of molten stearic acid is charged into the stripper to maintain the fluidity of the reaction product therein after the initial portion of unreacted fatty acids is removed. The removal of the unreacted fatty acids of the charged stock is completed by further increasing the vacuum to about 27½ inches of mercury and maintaining it at this level, while the mass in the stripper is maintained at 450° F for a period of about 45 minutes. At this point, the pressure is brought back to atmospheric by shutting off the vacuum ejectors and introducing nitrogen into the stripper.

The fatty acids collected during the stripping are returned to the fatty acid charged tank for reuse in subsequent reactions.

After analyzing the completed batch of acyl isethionate, the reaction product, weighing 5,750 lbs. is discharged and cooled. The analysis shows that the acyl isethionate content is about 75.0%, corresponding to a yield of about 92% based on the isethionate charged to the reactor.

EXAMPLE 2

This example illustrates the effectivness as an anti-mush agent of a $C_{12}$ and a $C_{14}$ sodium alkanesulfonate, namely sodium dodecanesulfonate and sodium tetradecanesulfonate, as manifested by a more rapid loss of water from the mush, or hydrated tablet, formed when the tablet is used for hand washing and left in the holder.

Tablets are prepared having the following compositions:

| | Percent By Weight | |
|---|---|---|
| | With Alkane Sulfonate | Control |
| Sodium acyl isethionate (active basis)[a] | 42.39 | 49.87 |
| Stearic acid | 17.17 | 20.20 |
| Coconut oil fatty acid | 2.62 | 3.08 |
| Soap of mixed tallow and coconut oil[b] | 7.08 | 8.33 |
| Sodium stearate | 2.54 | 2.99 |
| Sodium isethionate | 4.07 | 4.79 |
| Sodium alkylbenzenesulfonate[c] | 1.72 | 2.02 |
| Sodium chloride | 0.30 | 0.35 |
| Sodium alkanesulfonate | 15.00 | none |
| Water | 4.50 | 5.30 |
| $TiO_2$ | 0.17 | 0.20 |
| Perfume | 0.68 | 0.80 |
| Miscellaneous[d] | 1.76 | 2.07 |
| | 100.00 | 100.00 |

[a]prepared as in Example 1.
[b]sodium soap from a blend of 80% tallow and 20% coconut oil.
[c]alkyl group in a straight chain having about 11 to about 15 carbon atoms and the sulfonated phenyl group is randomly positioned along the alkyl chain.
[d]inert matter unavoidably added in associate with the components.

Into tablets having the foregoing compositions are separately incorporated 15% sodium dodecanesulfonate, 15% sodium tetradecanesulfonate, and 15% sodium hexadecanesulfonate. The tablets are subjected to the Firmness Recovery Test and the Wear Rate Test described hereinabove. From the results of these tests as recorded in Table I below, it may be seen that both the $C_{12}$ and $C_{14}$ alkanesulfonates cause the mush to lose water more rapidly than the control tablet, although at some expense in rate of wear.

The criticality of chain length is demonstrated in this series of tests, wherein the $C_{16}$ alkanesulfonate is shown to be ineffective for promoting water loss from the mush.

TABLE I

Effect of $C_{12}$, $C_{14}$, and $C_{16}$ Sodium Alkanesulfonates in an Acyl Isethionate Detergent Toilet Tablet

| | Water Lost in 2½ Hours | Wear Rate, g./Wash |
|---|---|---|
| Control | 77% | 3.27 ± 0.31 |
| 15% sodium dodecanesulfonate ($C_{12}$) | 84% | 4.93 ± 0.83 |
| 15% sodium tetradecanesulfonate ($C_{14}$) | 95% | 3.97 ± 0.51 |
| 15% sodium hexadecanesulfonate ($C_{16}$) | 53% | 3.20 ± 0.24 |

EXAMPLE 3

In this example another set of control tablets is prepared along with a set containing 15% sodium tetradecanesulfonate, the tablets having the compositions set forth in Example 2. The tablets are submitted to the Firmness Recovery Test, the Wear Rate Test, and the Lather Test described hereinabove. The results are recorded in Table II below. It may be seen that the presence of the sodium tetradecanesulfonate has the desirable effect of causing the mush to lose water more rapidly than the control tablet and in addition improves the lathering properties, at some expense however to the wear rate.

TABLE II

Effect of Sodium Tetradecanesulfonate in an Acyl Isethionate Detergent Toilet Tablet

| | Water Lost in 2½ hours | Wear Rate, g./Wash | Lather Rating |
|---|---|---|---|
| Control | 85% | 4.12 ± 0.24 | 24.5 |
| 15% sodium tetradecanesulfonate ($C_{14}$) | 100% | 5.12 ± 0.39 | 18.0 |

EXAMPLE 4

The following compositions in tablet form are within the scope of the invention:

| Composition | 1 | 2 | 3 | 4 | 5 | 6 | 7 |
|---|---|---|---|---|---|---|---|
| Sodium acyl isethionate | 30 | 50 | 60 | 40 | 50 | 60 | 40 |
| Fatty acid | 20 | 12.2 | 10.7 | 17.7 | 14 | 12.7 | 19 |
| Soap of a higher fatty acid | 10.2 | 10 | 6 | 7 | 8.7 | 5 | 8.7 |
| Sodium isethionate | 2 | 1.5 | 1.5 | 2.5 | 1.5 | 2 | 2 |
| Sodium alkylbenzenesulfonate | 2 | 2 | 2 | 2 | 2 | — | 2 |
| Sodium chloride | 0.3 | 0.3 | 0.3 | 0.3 | 0.3 | 0.3 | 0.3 |
| Sodium dodecanesulfonate | 20 | 15 | 10 | 10 | — | — | — |
| Sodium tetradecanesulfonate | — | — | — | 10 | 15 | 10 | 10 |
| Water | 6 | 4 | 3 | 4 | 5 | 4 | 4 |
| $TiO_2$ | 0.2 | 0.2 | 0.2 | 0.2 | 0.2 | 0.2 | 0.2 |
| Colorant (0.1% aqueous solution) | 0.1 | 0.1 | 0.1 | 0.1 | 0.1 | 0.1 | 0.1 |
| Perfume | 1 | 1 | 1 | 1 | 1 | 1 | 1 |
| Miscellaneous | 3.2 | 3.7 | 5.2 | 5.2 | 2.2 | 4.7 | 2.7 |
| | 100.0 | 100.0 | 100.0 | 100.0 | 100.0 | 100.0 | 100.0 |

The ingredients are defined as in Example 2.

Having described and set forth the best modes for carrying out the invention, modifications within the spirit thereof will occur to those skilled in the art, and the invention is to be limited only within the scope of the appended claims.

What is claimed is:

1. A toilet detergent tablet comprising from about 30 to about 60% of water-soluble alkali metal detergent salts of esters of isethionic acid with mixed aliphatic fatty acids having from 6 to 18 carbon atoms and an iodine value of less than 20, of which mixed acids at least 75% have from 12 to 18 carbon atoms and up to 25% have from 6 to 10 carbon atoms, from 2 to 10% of at least one water-soluble suds-boosting detergent salt selected from the group consisting of alkali metal and organic amine higher aliphatic fatty alcohol sulfates, alkyl aryl sulfonates, and the higher aliphatic fatty acid taurides, from about 1 to about 9% water, from about 2.5 to about 25% of water-soluble higher fatty acid soap, from 10 to 40% of at least one higher fatty acid having from about twelve to about twenty-five carbon atoms as a binder and plasticizer, and as an anti-mushing agent, about 10 to about 20% of sodium alkanesulfonate wherein the alkane group has 12 to 14 carbon atoms, or mixtures thereof, said tablet having improved hardness, improved firmness recovery characteristics, and being substantially free from efflorescence, and having a pH within the range of about 6 to about 8, measured as a 10% aqueous solution of the bar composition at 35° C.

2. A toilet detergent tablet in accordance with claim 1 wherein said sodium alkanesulfonate is sodium dodecanesulfonate.

3. A toilet detergent tablet in accordance with claim 1 wherein said sodium alkanesulfonate is sodium tetradecanesulfonate.

4. A toilet detergent tablet in accordance with claim 1 wherein said water-soluble higher fatty acid soap comprises about 25% potassium soap and about 75% sodium soap.

5. A toilet detergent tablet comprising:

| | Parts by Weight of Tablet |
|---|---|
| a. Sodium acyl isethionate | 40–60 |
| b. Fatty acid | 15–25 |
| c. Soap of a higher fatty acid | 5–15 |
| d. Sodium isethionate | 2–5 |
| e. Sodium alkylbenzenesulfonate | 2–4 |
| f. Sodium alkanesulfonate having 12–14 carbon atoms | 10–20 |
| g. Water | 3–6 |

wherein the acyl portion of said isethionate is derived from coconut oil, said fatty acid is selected from the group consisting of palmitic and stearic acids, said soap is the sodium salt of an aliphatic monocarboxylic acid having from about 8 to about 18 carbon atoms, of which about 18–22% has 8–14 carbon atoms, the alkyl group of said alkylbenzenesulfonate is derived from a straight-chain hydrocarbon mixture having an average of about 13 carbon atoms, the sum of (a) through (g) lies within the range of about 96 to about 100 parts by weight, whole composition basis.

6. A toilet detergent tablet in accordance with claim 5, based on 100 parts by weight of the total composition, comprising:

| | Parts By Weight of Tablet |
|---|---|
| Sodium acyl isethionate | 44–45 |
| Stearic acid | 17–19 |
| Coconut oil fatty acids | 2–3 |
| Sodium soap of mixed tallow and coconut oil | 7–8 |
| Sodium stearate | 2–3 |
| Sodium isethionate | 4–5 |
| Sodium alkylbenzenesulfonate | 2–3 |
| Sodium tetradecanesulfonate | 13–17 |
| Sodium chloride | 0.1–0.3 |
| $TiO_2$ | 0.1–0.3 |
| Germicides | 0–1.5 |
| Perfume | 0.7–1.5 |
| Colorants | 0.001–0.003 |
| [Miscellaneous] Inert matter | 1.5–3 |
| Water | 4–5 |

wherein the acyl portion of said acyl isethionate is derived from coconut oil, the alkyl portion of said sodium alkylbenzenesulfonate is derived from a straight-chain hydrocarbon mixture having about 11–15 carbon atoms, and said mixed tallow and coconut oil comprises about 75–85 parts tallow and about 15–25 parts coconut oil.

7. A process for lessening the mushing tendencies of a toilet detergent tablet containing an acyl isethionate in a proportion not exceeded by any other component therein, and in the proportions of about 30 to about 60%, comprising incorporating into said tablet from about 10 to about 20% of an anti-mushing agent selected from the group consisting of sodium dodecanesulfonate and sodium tetradecanesulfonate, and mixtures of said agents, said tablet having improved hardness, improved firmness recovery characteristics, and being substantially free from efflorescence, and having a pH within the range of about 6 to about 8, measured as a 10% aqueous solution of the bar composition at 35° C.

* * * * *